United States Patent [19]

Willingham

[11] Patent Number: 4,709,928

[45] Date of Patent: Dec. 1, 1987

[54] CIRCULAR GAME BOARD FOLDABLE INTO SMALL VOLUME

[76] Inventor: W. Preston Willingham, 1399 ½ Miller Ave., Winter Park, Fla. 32789

[21] Appl. No.: 876,119

[22] Filed: Jun. 19, 1986

[51] Int. Cl.[4] ..... A63F 9/00

[52] U.S. Cl. ..... 273/309; 273/286; 273/424; 446/46

[58] Field of Search ..... 273/286, 309, 424, 425; 217/91, 92; 446/46

[56] References Cited

U.S. PATENT DOCUMENTS

| | | | |
|---|---|---|---|
| 964,740 | 7/1910 | Barnes | 273/156 |
| 2,667,353 | 1/1954 | Lanice | 273/286 |
| 3,623,728 | 11/1971 | Goldfarb | 273/109 |
| 4,151,994 | 5/1979 | Stalberger | 273/415 X |
| 4,223,473 | 9/1980 | Brown | 446/46 |
| 4,241,533 | 12/1980 | Newsome | 446/46 |
| 4,290,226 | 9/1981 | Stauffer | 273/424 X |

FOREIGN PATENT DOCUMENTS

| | | | |
|---|---|---|---|
| 2076671 | 12/1981 | United Kingdom | 446/46 |

*Primary Examiner*—Anton O. Oechsle
*Attorney, Agent, or Firm*—Julian C. Renfro

[57] ABSTRACT

A circular game board foldable into thirds for storage, comprising a circular playing surface bounded by a generally tubular member affixed around the periphery of the playing surface. An elongate spring-like member is disposed in the tubular member, and an appropriate device is used for securing the ends of the spring-like member together so as to create an endless ring. This spring-like member is preferably in the form of a length of thin metal or plastic, whose ends have been joined together after insertion into the tubular member to form the endless ring serving to keep the playing surface taut. Quite advantageously, the game board is readily foldable into a smaller configuration for storage.

18 Claims, 8 Drawing Figures

CIRCULAR GAME BOARD FOLDABLE INTO SMALL VOLUME

BACKGROUND OF THE INVENTION

In the past a number of folding game boards have been marketed, these being configured such that the game board can be stored more conveniently than would be possible if its size could not be reduced. In some instances, the board has been made of relatively stiff material, with certain portions hinged together as will readily permit folding of the board when the game has been completed.

A different type of folding board is one made of comparatively soft material, as will permit it to be either folded or rolled into a smaller package. One example of such a board is the Lanice U.S. Pat. No. 2,667,353 entitled "Chess Game Device". That patentee provides a substantially square board made of "textile fabric", suede, or other soft pliable material. This patentee paints or otherwise places a suitable number of squares on the board, typically of alternating colors, as will permit games such as chess, checkers and the like to be played. He provides a zipper around the perimeter of the board so that after the game is over, the board can be zipped closed, and then rolled up.

Although this type of folding board might be desirable for such games when played by an older age group, I have found that the younger set do not like an extremely soft playing surface, and would far prefer a playing surface normally maintained in a taut condition, so that certain dice games, for example, can be played thereon.

In exploring the use of a circular game boards, I have become aware of patents having issued upon certain flying disc games, such as represented by the Brown U.S. Pat. No. 4,223,473 and the Newsome U.S. Pat. No. 4,241,533. Both of these flying toys are designed to be thrown by the hand so that they will fly or glide for a certain distance, perhaps to be caught by a second player. Devices of these latter two types are advantageous over the conventional "Frisbee" device made of hard plastic, in that they are foldable into a small, compact unit, and they are less likely to cause damage should the device strike a person, a window pane or the like.

However, none of the foregoing devices was suitable insofar as providing a taut surface upon which certain games can be played, and it was as a result of trying to improve upon these and other prior art devices that the present invention was evolved.

SUMMARY OF THE INVENTION

A circular game board in accordance with this invention comprises a circular playing surface bounded by a generally tubular member affixed around the periphery of the playing surface. In this tubular member an endless spring-like member is disposed, which spring-like member normally serves to keep the playing surface in a desirably taut condition.

The circular playing surface can be made of soft leather, soft plastic, or any of a number of textile fabrics. the manufacturer may print or paint instructions, a trademark, or even advertising material on one or both sides of the playing surface. The spring-like member can be of certain metal or certain plastics, and is selected to be of a length such that it will completely encircle the playing surface when inserted into the tubular member, with adjacent ends of the spring-like member then being joined together to form an endless ring.

My game board is characterized by its most attractive, taut, and highly desirable playing surface, its compactness, and its convenience.

At the time the game has been completed, the user can then very advantageously fold my circular game board into a smaller configuration for storage. This is accomplished by the user grasping opposite sides of the game board, and then applying a form of twisting motion so as to cause the game board to form three loops, with each loop being of a diameter substantially less than the original diameter of the playing board. The twisting can be accomplished comparatively effortlessly, and when continued, it causes the nesting of the game board into thirds. The three loops thus formed amount to a small, flat, generally circular configuration that is ideal for storage.

Although my game board can be manufactured quite inexpensively, it is also well suited to being manufactured as a type of status symbol, in which case it will typically be manufactured using a high quality leather, and be accompanied by a small leather pouch for carrying dice, an instruction sheet, score cards and the like. All of these can be carried in a carrying case handsomely executed in high quality leather.

It is therefore a primary object of my invention to provide a circular game board that is in a taut condition for use, yet being foldable into thirds to permit easy storage.

It is another object of my invention to provide a circular game board which can be deployed readily, folded for storage easily, and which presents a particularly attractive game board upon which certain dice games or other games can be played.

These and other objects, features and advantages will be more apparent upon a study of the enclosed drawings.

DETAILED DESCRIPTION

Figure 1:
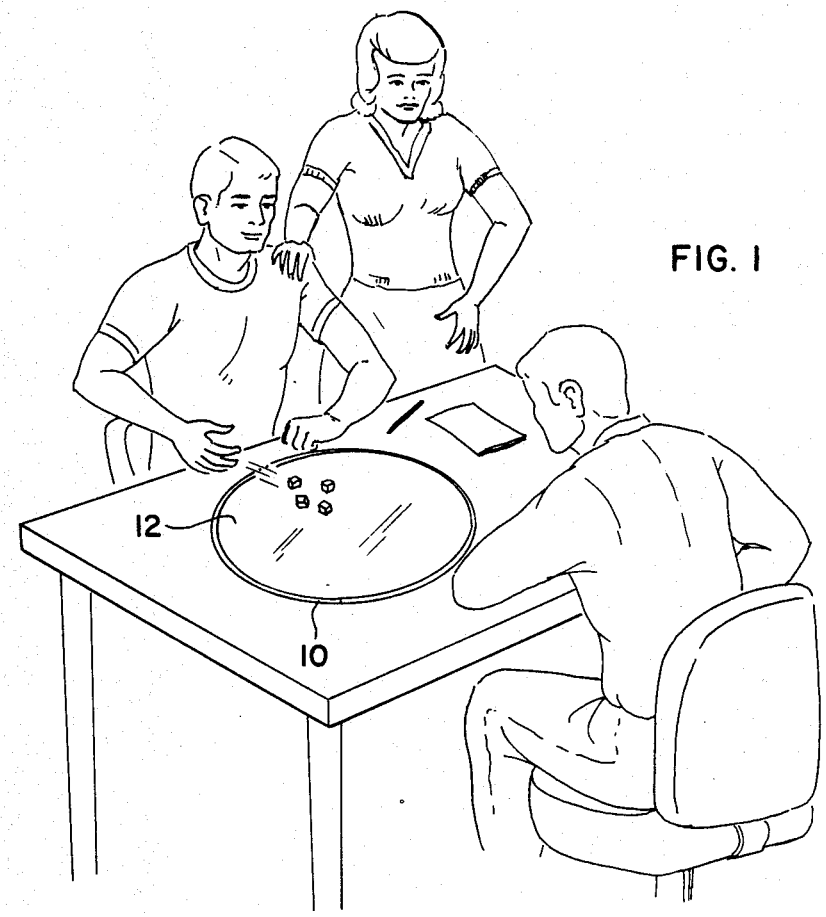
FIG. 1 is a view showing a typical usage of my board, involving in this instance a pair of players playing a dice game.

Turning to FIG. 1, it will there be seen that I reveal two players utilizing a circular game board 10 in accordance with this invention, involving a circular playing surface 12 held in a desirably taut condition, as will permit any of a number of different games to be played thereon.

As may be preferred, the circular playing surface may be made of soft leather, soft plastic, or cloth, and if desired, certain information may be painted or printed on either or both sides thereof. No particular size of playing board is required, but I have found that a circular playing board approximately 22 inches in diameter is particularly convenient.

Figure 2:
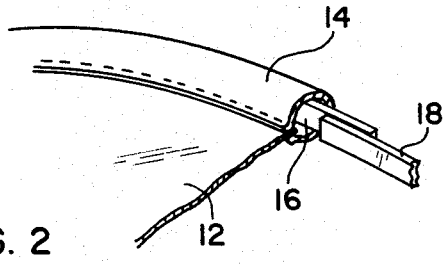
FIG. 2 is a fragmentary view to a larger scale showing a portion of the surface of the game board, a portion of the tubular member secured around the game board, and the ends of the spring-like member secured together in an overlapping manner.

Around the periphery of the playing surface is a tubular member 14 in which is to be located a spring-like member serving to hold the playing surface in a desirably taut condition. As best seen in FIG. 2 and related figures, the tubular member 14 can be sewn around the periphery of the playing surface 12, or it may be secured there by other means, such as by the use of cement, staples, or the like.

Into a small aperture 16 placed at one location in the tubular member 14, I insert a long, thin member 18 of metal or plastic, that has been selected for its spring-like characteristics. The long thin member 18 is of a length sufficient that it can pass around the entire periphery of the playing surface, and its two ends then joined together to form an endless ring or hoop of approximately the same diameter as the playing surface.

As an example, if the member 18 is of steel, I may spot weld the slightly overlapped ends so as to form a permanent, endless ring, as illustrated in FIG. 2. On the other hand, if the member 18 is of plastic, I may glue or cement the slightly overlapped ends of the plastic member together so as to form a permanent, endless ring.

Figure 3:
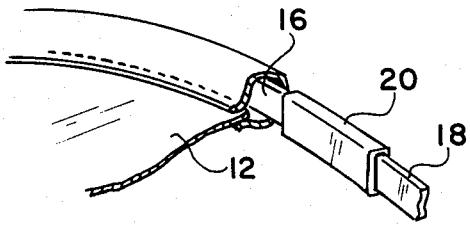
FIG. 3 is a view similar to FIG. 2, except that a slider member is utilized for holding the ends of the spring-like member together.
Figure 4:
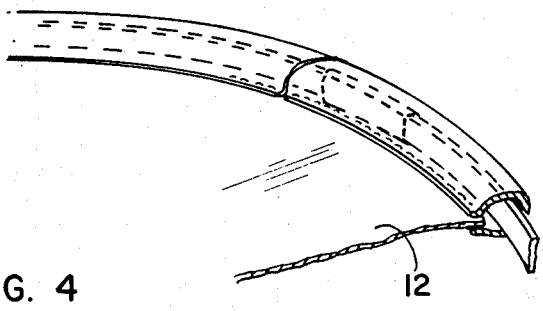
FIG. 4 is a fragmentary view showing how the ends of the tubular member are overlapped so as to hide the location at which the ends of the spring-like member were secured together.

FIG. 3 represents a different approach that may be used if it is not desired to use spot welding or cementing techniques. In this embodiment, a slider member 20 may be used to join the ends of the thin member 18 together. If a steel member 18 is involved, the metal slider member 20 may be welded to one end of the member, and after the member 18 has been threaded around the entire periphery of the game board, the free end can be inserted into a small aperture or slot remaining in the slider member.

Alternatively, the slider may be applied to the ends of the member 18 after the threading through the tubular member 14 is complete, and then a crimping tool used to compress the slider member tightly around the slightly overlapped (or butted) ends of the member 18.

If the member 18 is of plastic, a plastic or metal slider member 20 may be utilized for joining the ends in order to create the endless ring. A metal slider member 20 can be crimped around the ends, and a plastic slider member may be glued or cemented to the ends of member 18.

As should be apparent, the use of the member 18 serves to hold the playing surface in a taut condition that is ideal for a number of different games. As one example, I may play a game known by some as "six dice", and variously known by others as "greed", "ten thousand", or "bust". This game entails each player taking his or her turn at rolling six dice onto the playing surface, after which a point count is made. Various scoring can be given each player, depending how many "ones", "threes" or the like are obtained on each roll, or even points given somewhat in accordance with a poker hand.

My game board quite obviously can be deployed on a desk or table, or even on the floor or on the beach. Because of the highly desirable texture of the playing surface, the dice roll much more satisfactorily than they would on a hard surface.

If the playing surface is leather, it may be desirable to use either the suede surface or the smooth surface for the playing of the game. Quite obviously, leather may also be used in the construction of the small pouch in which the dice, scoring cards, explanation card and the like are carried, and also used in the construction of the carrying case.

Figure 5A:
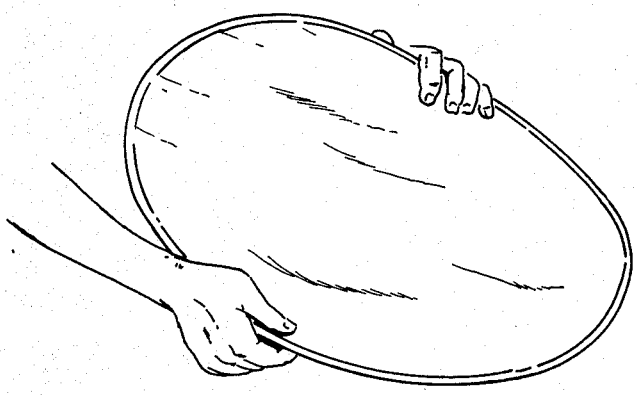
FIGS. 5*a* through 5*d* show a typical sequence the user may utilize in folding my novel circular board into a small configuration for storage.
Figure 5B:
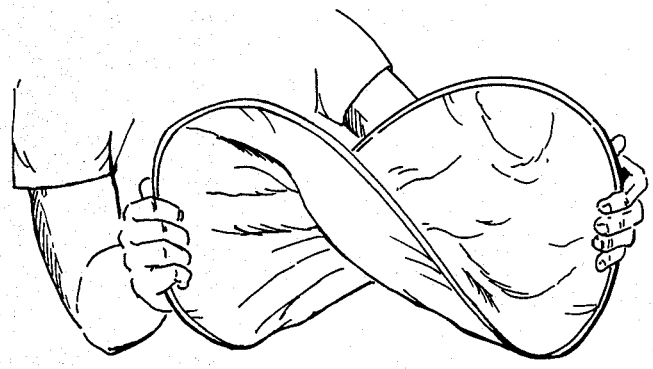

At the completion of the game, the folding of the board can be accomplished quite readily. The player grasps opposite sides of the playing board at locations that are approximately 180° apart, as shown in FIG. 5*a*. Preferably he or she places the tips of the fingers of the other hand on the opposite surface of the board. Then, in a form of twisting motion, the hands are moved in opposite rotative directions so as to cause the diameter of the outer ring to distort considerably, in one phase passing through a condition in which the game board forms more or less of a U-shaped configuration, as revealed in FIG. 5*b*.

Figure 5C:
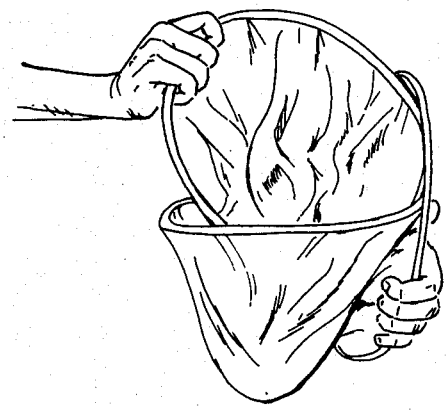
Figure 5D:
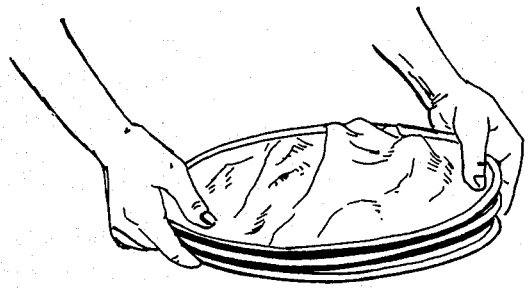

Continued twisting of the hands causes the outer ring to form three lesser rings of comparatively small diameter, visible in FIG. 5*c*, which rings will nest together in a neat, flat package or configuration as shown in FIG. 5*d*. When in this flat configuration, the entire game board can be inserted into a pouch having an opening approximately 9 inches across. Although my invention in no way is size limited, it is of interest to note that in one embodiment some 22 inches in diameter, the twisting of the outer member caused each of the three loops or folds of the device to be approximately 8 inches in diameter, and grouped closely together as revealed in FIG. 5*d*.

It may be of interest to note that the folding of my game board in the above described manner can be accomplished equally well despite the fact that a right-handed player might for example rotate his right hand away from his body, and his left hand toward his body during the commencement of the folding operation, whereas a left handed player might for example rotate his left hand away from his body and his right hand toward his body during the initial part of the folding operation.

My game board is believed to be unlike any other known game board in this regard, although the reader will probably be aware of the fact that when continuous band saw blades are packaged for sale, they typically are folded into thirds, as described herein with respect to my gameboard.

Other aspects and uses of my invention will be apparent to the reader, and I am not to be limited except as required by the scope of the appended claims.

I claim:

1. A circular game board foldable into thirds for storage, comprising a circular playing surface bounded by a generally tubular member affixed around the periphery of said playing surface, a spring-like member disposed in said tubular member, which spring-like member normally serves to keep said playing surface in a taut condition, means for securing the ends of said spring-like member together so as to create an endless ring, said game board being readily foldable into a smaller configuration for storage, said spring-like member being in the form of a length of thin metal, whose ends have been joined together after insertion into said tubular member to form the endless ring serving to keep said playing surface taut.

2. The circular game board as recited in claim 1 in which the ends of said spring-like member are joined together by welding.

3. The circular game board as recited in claim 1 wherein the ends of said spring-like member are secured together by clamping means.

4. The circular game board as recited in claim 1 wherein said playing surface is made of leather.

5. The circular game board as recited in claim 1 wherein said playing surface is made of soft plastic.

6. The circular game board as recited in claim 1 wherein said playing surface is made of soft fabric.

7. A circular game board foldable into thirds for storage, comprising a circular playing surface bounded by a generally tubular member affixed around the periphery of said playing surface, a spring-like member disposed in said tubular member, which spring-like member normally serves to keep said playing surface in a taut condition, means for securing the ends of said spring-like member together so as to create an endless ring, said game board being readily foldable into a smaller configuration for storage, said spring-like member being in the form of a length of thin plastic, which ends have been joined together after insertion into said tubular member to form an endless ring serving to keep the playing surface taut.

8. The circular game board as recited in claim 7 in which the ends of said spring-like member are secured together by cementing.

9. The circular game board as recited in claim 7 in which the ends of said spring-like member are secured together by clamping means.

10. A circular game board foldable into thirds for storage, comprising a circular playing surface bounded by a generally tubular member affixed around the periphery of said playing surface, an endless spring-like member disposed in said tubular member, which spring-like member normally serves to keep said playing surface in a taut condition, said game board being foldable into a smaller configuration for storage, by grasping opposite sides of said game board, and applying a form of twisting motion as to cause said game board to form three loops, each loop being of a diameter substantially less than the original diameter of said playing board, with continued twisting motion causing the nesting of said three loops into a small, flat, generally circular configuration for storage, said spring-like member being in the form of a length of thin metal, whose ends have been joined together after insertion into said tubular member to form the endless ring serving to keep said playing surface taut.

11. The circular game board as recited in claim 10 in which the ends of said spring-like member are joined together by welding.

12. The circular game board as recited in claim 10 wherein the ends of said spring-like member are secured together by clamping means.

13. The circular game board as recited in claim 10 wherein the playing surface is made of soft leather.

14. The circular game board as recited in claim 10 wherein the playing surface is made of soft plastic.

15. The circular game board as recited in claim 10 wherein the playing surface is made of soft fabric.

16. A circular game board foldable into thirds for storage, comprising a circular playing surface bounded by a generally tubular member affixed around the periphery of said playing surface, an endless spring-like member disposed in said tubular member, which spring-like member normally serves to keep said playing surface in a taut condition, said game board being foldable into a smaller configuration for storage, by grasping opposite sides of said game board, and applying a form of twisting motion as to cause said game board to form three loops, each loop being of a diameter substantially less than the original diameter of said playing board, with continued twisting motion causing the nesting of said three loops into a small, flat, generally circular configuration for storage, said spring-like member being in the form of a length of thin plastic, which ends have been joined together after insertion into said tubular member to form an endless ring serving to keep the playing surface taut.

17. The circular game board as recited in claim 16 wherein the ends of said spring-like member are secured together by cementing.

18. The circular game board as recited in claim 16 in which the ends of said spring-like member are secured together by clamping means.

* * * * *